US009323210B2

(12) United States Patent
Morita et al.

(10) Patent No.: US 9,323,210 B2
(45) Date of Patent: Apr. 26, 2016

(54) IMAGE FORMING APPARATUS

(71) Applicant: BROTHER KOGYO KABUSHIKI KAISHA, Nagoya-shi, Aichi-ken (JP)

(72) Inventors: Tetsuya Morita, Nagoya (JP); Hikaru Iino, Aichi-ken (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/553,051

(22) Filed: Nov. 25, 2014

(65) Prior Publication Data

US 2015/0147087 A1 May 28, 2015

(30) Foreign Application Priority Data

Nov. 27, 2013 (JP) ..... 2013-245365

(51) Int. Cl.
*G03G 15/00* (2006.01)
*G03G 21/16* (2006.01)
*G03G 21/18* (2006.01)

(52) U.S. Cl.
CPC ..... *G03G 21/1619* (2013.01); *G03G 21/1633* (2013.01); *G03G 21/1647* (2013.01); *G03G 21/1842* (2013.01); *G03G 2215/00383* (2013.01); *G03G 2215/00392* (2013.01)

(58) Field of Classification Search
CPC ..... G03G 21/1619; G03G 21/1609; G03G 21/1633; G03G 21/16; G03G 21/1853
USPC ..... 399/107, 110, 111, 124
See application file for complete search history.

(56) References Cited

U.S. PATENT DOCUMENTS 8,406,657 B2 * 3/2013 Kikuchi et al. ..... 399/112

FOREIGN PATENT DOCUMENTS

JP 2007-106524 A 4/2007

* cited by examiner

*Primary Examiner* — Hoang Ngo
(74) *Attorney, Agent, or Firm* — Merchant & Gould P.C.

(57) ABSTRACT

An image forming apparatus includes a casing including a first side frame, a second side frame, and an opening, a cartridge configured to be attached to and removed from the casing through the opening, and an openable member configured to open and close the opening. A first side and a second side of the cartridge are supported by the first side frame and the second side frame, respectively, when the cartridge is attached to the casing. A part of the cartridge attached to the casing protrudes in a removal direction of the cartridge relative to an end of each of the first side frame and the second side frame in the removal direction. The openable member includes a wall portion. When the openable member closes the opening, the wall portion of the openable member is spaced apart in the removal direction from the part of the cartridge attached to the casing.

11 Claims, 5 Drawing Sheets

IMAGE FORMING APPARATUS

CROSS REFERENCE TO RELATED APPLICATION

This application claims priority from Japanese Patent Application No. 2013-245365, filed on Nov. 27, 2013, which is incorporated herein by reference in its entirety.

TECHNICAL FIELD

Aspects of the disclosure relate to an image forming apparatus including an openable member to open and close an opening on one side of a casing.

BACKGROUND

A known image forming apparatus has a casing to which a cartridge storing developer is attached. The image forming apparatus is configured such that the cartridge is detachably attachable to the casing by opening a front cover of the casing.

SUMMARY

In the above image forming apparatus, when the need to increase the physical size of the cartridge for increasing the capacity for developer is required, the need to increase the physical size of the casing is required to increase space for storing the cartridge. However, if the physical size of the casing is increased, a large footprint is required.

Illustrative aspects of the disclosure provide an image forming apparatus having an increased space for accommodating a cartridge without the need to increase the size of a footprint of a casing.

According to an aspect of the disclosure, an image forming apparatus includes a casing, a cartridge, and an openable member. The casing has a first side frame, a second side frame disposed opposite to the first frame, the firs side frame and the second side frame partially defining an opening therebetween. The cartridge is configured to be attached to and removed from the casing through the opening. A first side and a second side of the cartridge are supported by the first side frame and the second side frame, respectively, when the cartridge is attached to the casing. The openable member is configured to open and close the opening. A part of the cartridge attached to the casing protrudes in a removal direction of the cartridge relative to an end of each of the first side frame and the second side frame in the removal direction. The openable member includes a wall portion. When the openable member closes the opening, the wall portion of the openable member is spaced apart in the removal direction from the part of the cartridge attached to the casing.

With this structure, the image forming apparatus has an increased space for accommodating the cartridge. Even when the cartridge attached to the casing protrudes in the removal direction relative to the end of each of the first side frame and the second side frame in the removal direction, the cartridge can be accommodated inside relative to the openable member.

BRIEF DESCRIPTION OF THE DRAWINGS

Reference is made to the following description taken in connection with the accompanying drawings, like reference numerals being used for like corresponding parts in the various drawings.

DETAILED DESCRIPTION

A first embodiment of the disclosure will be described with reference to the following drawings. The following description will be first made to a general structure of a laser printer 1 as an example of an image forming apparatus according to the embodiment of the disclosure.

In the following description, the expressions "front", "rear", "upper or top", "lower or bottom", "right", and "left" are used to define the various parts when the laser printer 1 is disposed in an orientation in which it is intended to be used.

Figure 1:
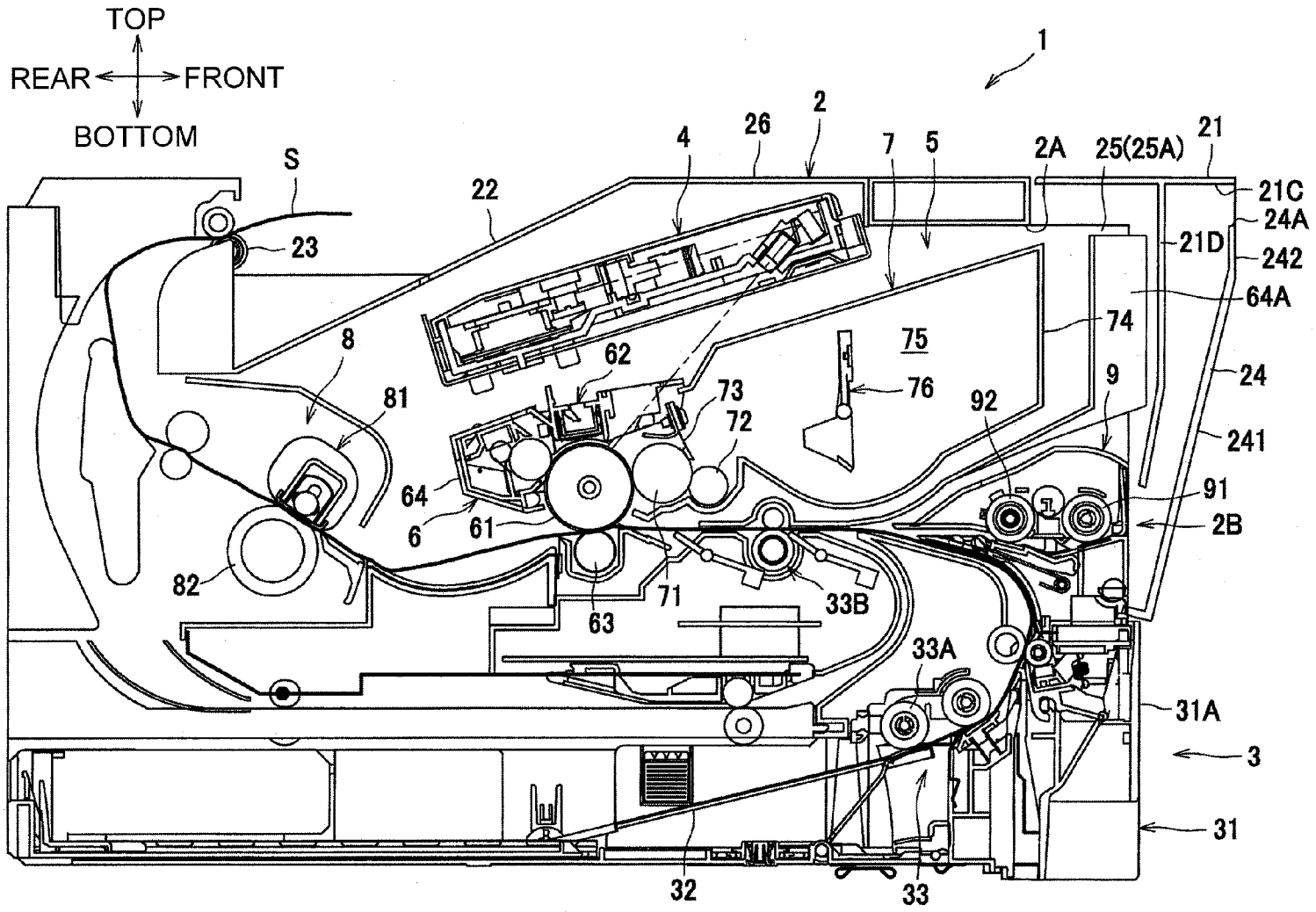
FIG. 1 is a sectional view illustrating a general structure of a printer according to a first illustrative embodiment.

As shown in FIG. 1, the laser printer 1 includes, in a casing 2, a sheet supply unit 3 for supplying a recording sheet, e.g., a sheet S, a light exposure unit 4, a process cartridge 5, as an example of a cartridge, for transferring a toner image onto a sheet S, a fixing unit 8 for fixing the toner image onto the sheet S, and a manual sheet feed mechanism 9.

One side, as an example of a front side, of the casing 2 has an opening 2A. The casing 2 has a front cover 21, as an example of an openable member, pivotable about a pivot axis, that is, a lower end of the front cover 21. The front cover 21 pivots to open or close the opening 2A.

The sheet supply unit 3 is disposed in a lower portion of the casing 2. The sheet supply unit 3 includes a sheet supply tray 31 as an example of a supply tray, a sheet pressing plate 32, and a sheet supply mechanism 33.

The sheet supply tray 31 is configured to store sheets S therein. The sheet supply tray 31 is detachably attached to the lower portion of the casing 2. The sheet supply tray 31 is pulled out from the casing 2 by pulling it toward the front, and is attached to the casing 2 by pressing it toward the rear.

The sheet pressing plate 32 is disposed below the sheets S stored in the sheet supply tray 31 such that a front end portion of the sheet pressing plate 32 is pivotable about a rear end portion of the sheet pressing plate 32.

The sheet supply mechanism 33 includes a pickup roller 33A and a pair of registration rollers 33B.

The pickup roller 33A is disposed above the front end portion of the sheet pressing plate 32 and configured to rotate in contact with a sheet S on the sheet pressing plate 32 such that the sheet S is fed into the casing 2.

The pair of registration rollers 33B is disposed on a sheet feed path between the pickup roller 33A and a photosensitive drum 61 included in the process cartridge 5. The pair of registration rollers 33B is configured to temporarily stop a sheet S by contacting a leading end of the sheet S before the sheet S is supplied to the photosensitive drum 61, to correct skewing of the sheet S and adjust timing for image formation on the sheet S.

In the sheet supply unit 3 structured above, a sheet S stored in the sheet supply tray 31 is raised toward the pickup roller 33A by the sheet pressing plate 32, and is supplied to (between the photosensitive drum 61 and a transfer roller 63 in) the process cartridge 5 by the sheet supply mechanism 33.

The light exposure unit 4 is disposed in an upper portion of the casing 2, and includes a laser emitting portion (not shown), a polygon mirror, lenses, and reflecting mirrors, which are illustrated without reference numerals. In the light exposure unit 4, laser light (see the dash-dot line) emitted from the laser light emitting portion based on image data may scan at high speed across the surface of the photosensitive drum 61 to expose the surface of the photosensitive drum 61 to light.

The process cartridge 5 is disposed below the light exposure unit 4 and is detachably attachable to the casing 2 through the opening 2A, which is opened when the front cover 21 pivots to the front.

The process cartridge 5 includes a drum cartridge 6 and a developing cartridge 7, which is detachably attached to the drum cartridge 6.

The drum cartridge 6 includes the photosensitive drum 61, a charger 62, the transfer roller 63, and a drum cartridge frame 64. The drum cartridge frame 64 supports, at is rear portion, the photosensitive drum 61, the charger 62, and the transfer roller 63. The drum cartridge frame 64 has, at its front end portion, a cartridge holding portion 64A for holding the drum cartridge 6 when detached from or attached to the casing 2.

The developing cartridge 7 is disposed between the photosensitive drum 61 of the drum cartridge 64 and the cartridge holding portion 64A, and is detachably attachable to the drum cartridge frame 64. The developing cartridge 7 includes a developing roller 71, a supply roller 72, a layer thickness regulating blade 73, and a developing cartridge frame 74 supporting these components 71, 72, and 73. The developing cartridge frame 74 has a toner storing portion 75 for storing toner inside, and the toner storing portion 75 has an agitator 76 for agitating toner in the toner storing portion 75.

In the process cartridge 5, the surface of the photosensitive drum 61 is uniformly charged by the charger 62, and exposed to the light with laser light from the light exposure unit 4 scanning at high speed, and an electrostatic latent image based on image data is formed on the surface of the photosensitive drum 61. Toner in the toner storing portion 75 is supplied via a supply roller 72 to a developing roller 71, enters between the developing roller 71 and a layer thickness regulating blade 73, and is carried on the developing roller 71 as a thin layer having a uniform thickness.

The toner carried on the developing roller 71 is supplied from the developing roller 71 to the electrostatic latent image formed on the photosensitive drum 61. Thereby, the electrostatic latent image is visualized as a toner image on the photosensitive drum 61. Then, when the sheet S is fed to between the photosensitive drum 61 and the transfer roller 63, the toner image on the photosensitive drum 61 is transferred onto the sheet S.

The fixing unit 8 is disposed at the rear of the process cartridge 5. The fixing unit 8 includes a heating unit 81 and a pressure roller 82. The heating unit 81 includes a halogen heater, a fixing belt, and a nip plate, which are illustrated without reference numerals, and the fixing belt is nipped between the nip plate of the heating unit 81 and the pressure roller 82. In the fixing unit 8, the toner image transferred onto the sheet S is thermally fixed while passing between the heating unit 81 and the pressure roller 82. The sheet S having the toner image thermally fixed is ejected to an ejection tray 22 disposed in the upper portion of the casing 2.

The manual sheet feed mechanism 9 is disposed in the front side of the casing 2 and above the sheet supply tray 31. The manual sheet feed mechanism 9 includes a sheet supply roller 91 and a separation roller 92, and is configured to feed a sheet S inserted through a manual feed port 2B, which is formed at a front surface of the casing 2, toward the registration rollers 33B. The manual feed port 2B is vertically defined between the opening 2A and the sheet supply tray 31, and opened and closed by a covering member 24 pivotally attached to the front cover 21.

A structure of the casing 2 will be described below.

Figure 2:
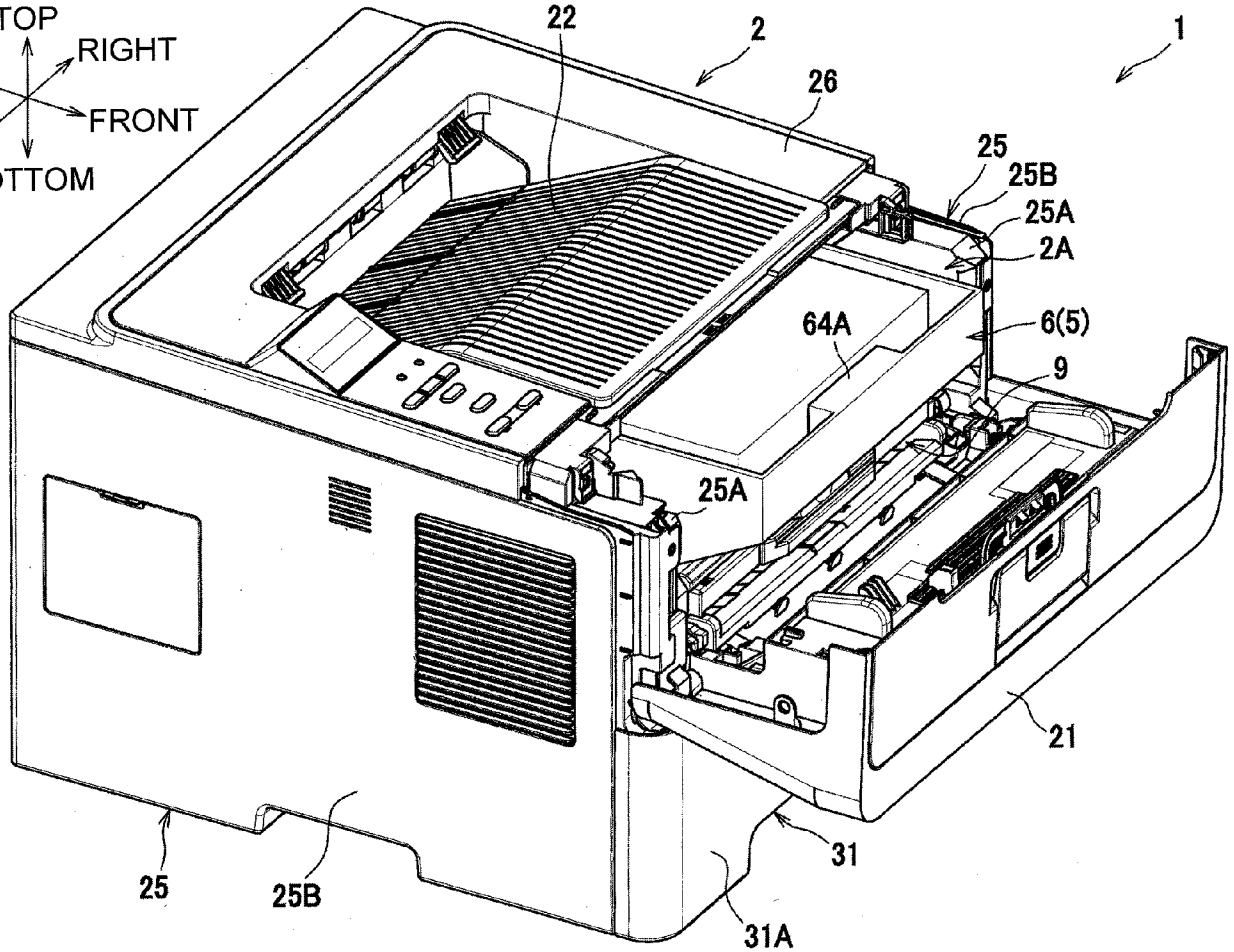
FIG. 2 is a perspective view of the laser printer with a front cover being open.

As shown in FIG. 2, the casing 2 has a pair of left and right sidewalls 25 disposed on left and right sides of the process cartridge 5, and an upper wall 26 disposed above the process cartridge 5.

Each sidewall 25 includes a side frame 25A supporting the process cartridge 5 and a side cover 25B covering an outer surface of the side frame 25A in the left-right direction.

The upper wall 26 is disposed connecting the pair of sidewalls 25. Both ends of the upper wall 26 in the left-right direction are disposed on upper ends of the respective sidewalls 25. A front end of the upper wall 26 is located closer to the rear than a front end of each sidewall 25.

In the casing 2, a pair of side frames 25A, the upper wall 26, and the manual sheet feed mechanism 9 define the opening 2A.

In this embodiment, a part of the process cartridge 5 attached to the casing 2 protrudes through the opening 2A toward the front. That is, the part of the process cartridge 5 attached to the casing 2 protrudes in a removal direction of the process cartridge 5 relative to a front end of the pair of side frames 25A. Specifically, a front end portion of the cartridge holding portion 64A is located toward the front further than the side frames 25A.

Figure 3:
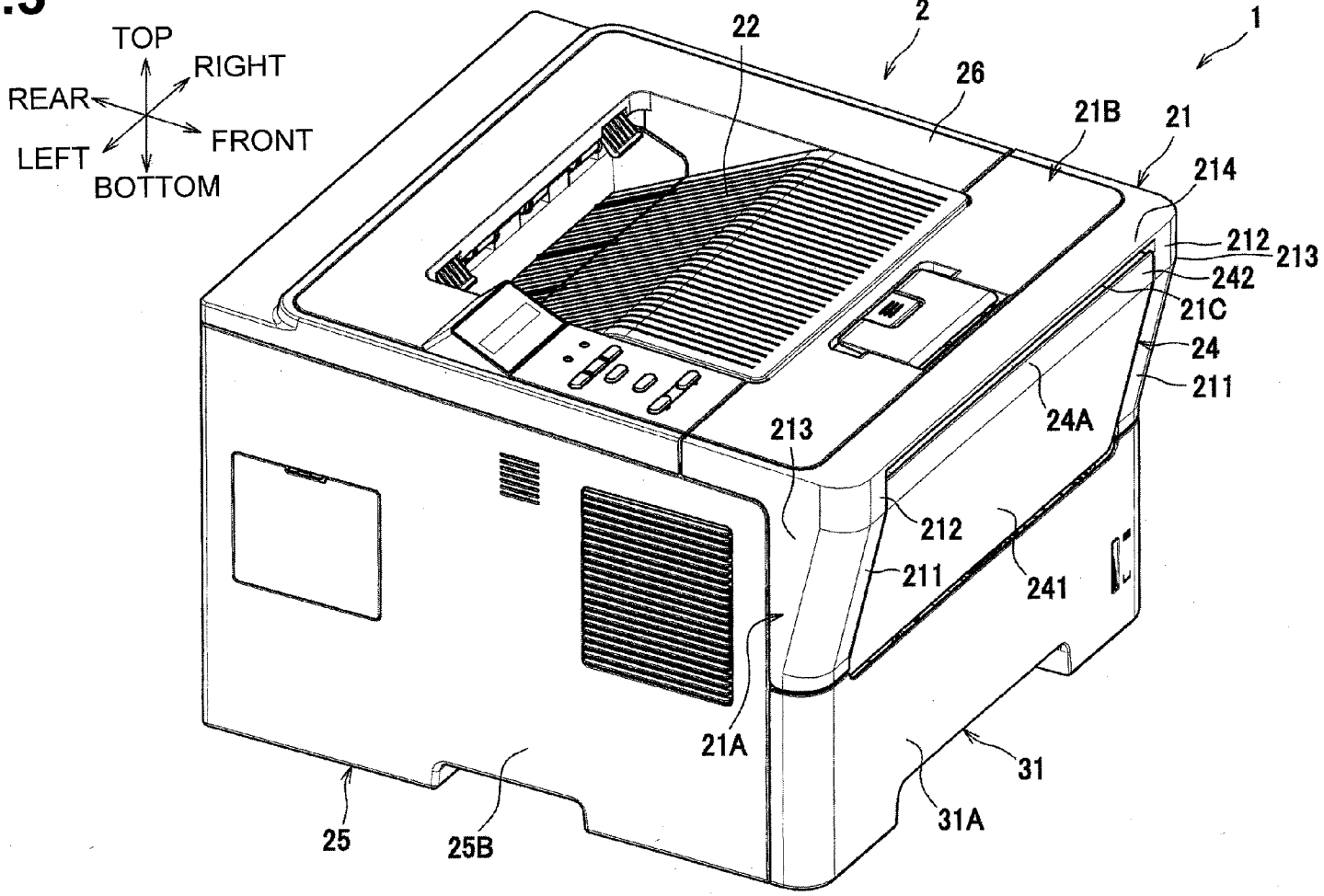
FIG. 3 is a perspective view of the laser printer with the front cover and a covering member being closed.

As the part of the process cartridge 5 protrudes through the opening 2A toward the front, as shown in FIG. 3, the front cover 21 is shaped such that a part corresponding to the opening 2A protrudes toward the front relative to a part corresponding to a part below the opening 2A.

Specifically, the front cover 21 includes a first part 21A constituting the front and side surfaces of the casing 2 above the sheet supply tray 31 and a second part 21B extending from an upper end of the first part 21A toward the front end of the upper wall 26 and constituting a front end portion of the upper surface of the casing 2.

The first part 21A is disposed such that, when the front cover 21 is closed, both ends of the first part 21A in the left-right direction overlap the respective side walls 25 from the front thereof. The second part 21B is disposed such that, when the front cover 21 is closed, both ends of the second part 21B in the left-right direction overlap the respective sidewalls 25 from above.

The sheet supply tray 31 is disposed such that both ends of a front wall 31A in the left-right direction overlap the respective sidewalls 25 from the front thereof. A front surface of the front wall 31A extends vertically.

The first part 21A of the front cover 21 protrudes toward the front relative to the front wall 31A of the sheet supply tray 31.

Specifically, the first part 21A of the front cover 21 includes a pair of left and right sidewall portions 213 and an upper wall portion 214. The left and right sidewall portions 213 overlap the left and right sidewalls 25, respectively, from the front when the front cover 21 is closed. The sidewall portions 213 are shaped such that upper portions thereof protrude toward the front. The upper wall portion 214 connects upper ends of the sidewalls 213. Front surfaces of the sidewall portions 213 and the upper wall portion 214 define the outer surface or the front surface of the front cover 21.

The front surface of the front cover 21 has inclined surfaces 211 and vertical surfaces 212. The inclined surfaces 211 are inclined, relative to a vertical direction and in a forward direction, from a position above the supply sheet tray 31 to an upper portion of the front cover 21. The vertical surfaces 212 extend vertically from upper ends of the inclined surfaces 211.

The front cover 21 has an opening 21 C surrounded by the left and right sidewall portions 213 and the upper wall portion 214. The covering member 24 is disposed within the opening 21C. As shown in FIG. 1, the front cover 21 includes a wall portion 21D, which is disposed between the covering member 24 and the process cartridge 5 and configured to cover the front side of the process cartridge 5. Thus, the process cartridge 5 is not exposed when the covering member 24 is open.

As shown in FIG. 3, the covering member 24 is shaped such that, when closed, it is flush with the inclined surfaces 211 and the vertical surfaces 212. A front surface of the covering member 24 has a first surface 241 and a second surface 242. The first surface 241 extends in parallel with the inclined surfaces 211 from lower ends to upper ends of the inclined surfaces 211. The second surface 242 extends in parallel with the vertical surfaces 212 from an upper end of the first surface 241. The second surface 242 extends up to an upper end of the covering member 24, and the upper end of the covering member 24 is an upper edge of the second surface 242.

The upper end of the covering member 24 is spaced from the upper wall portion 214 defining an edge partially defining the opening 21C. The covering member 24 can be held by a hand in a space between the upper end of the covering member 24 and the upper wall portion 214. Thus, an upper end portion of the covering member 24 functions as a holding portion 24A.

Figure 4:
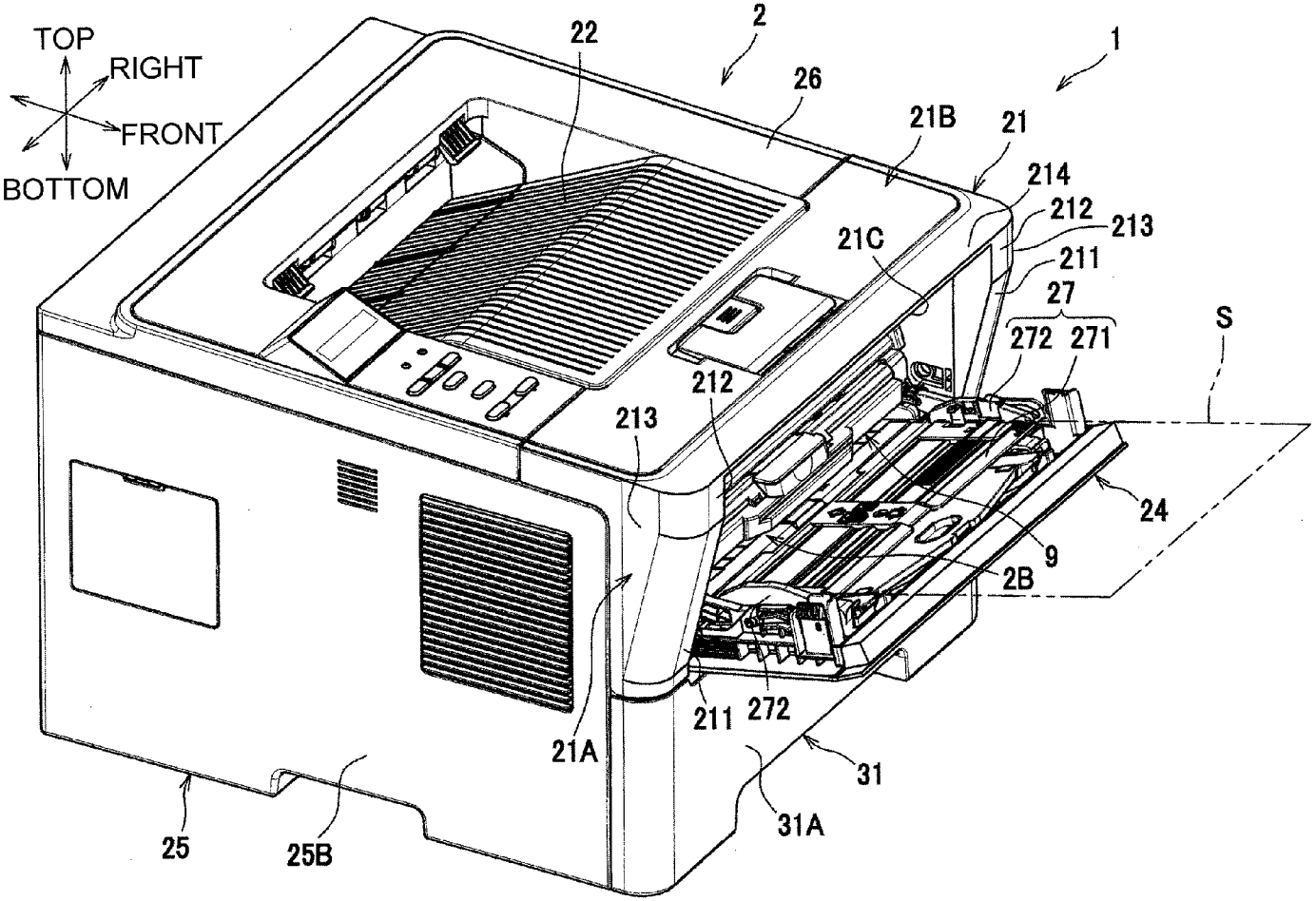
FIG. 4 is a perspective view of the laser printer with the covering member being open.

As shown in FIG. 4, the covering member 24 includes a tray portion 27 on an inner surface or a surface facing upward when the covering member 24 is open. The tray portion 27 is configured to support a sheet S. The tray portion 27 includes a tray 271 and sheet edge guides 272. The tray 271 is configured to support a sheet S and guide the sheet S to the manual feed port 2B. The sheet edge guides 272 are configured to position left and right edges of the sheet S supported on the tray 271.

Effects of the laser printer 1 as structured above will be described.

As shown in FIG. 1, the front cover 21 protrudes toward the front relative to the front surface 31A of the supply sheet tray 31. In other words, the wall portion 21D of the front cover 21 is disposed further toward the front than the sidewall 25. Thus, the laser printer 1 has an increased space for accommodating the process cartridge 5 compared with a case where the front cover 21 does not protrude or the front surface of the front cover 21 is flush with the front surface 31A of the supply sheet tray 31.

Thus, the laser printer 1 can accommodate the large-sized process cartridge 5 of which front end is located toward the front further than the front end of each of the side frames 25A as described in the embodiment.

The front cover 21 protrudes toward the front relative to the front surface 31A of the supply sheet tray 31. Thus, the size of the lower portion of the casing 2 may be set to a minimum size corresponding to a size required to install the supply sheet tray 31. Thus, a space for accommodating the process cartridge 5 can be increased without the need to increase the footprint of the casing 2.

The front surface of the front cover 21 has the inclined surfaces 211 that are inclined, relative to a vertical direction and in a frontward direction, from a position above the supply sheet tray 31 to an upper portion of the front cover 21. This structure prevents the front cover 21 from colliding with the supply sheet tray 31 when the front cover 21 is opened.

The front surface (the first surface 241 and the second surface 242) of the covering member 24 disposed in the front cover 21 is flush with the inclined surfaces 211 and the vertical surfaces 212 of the front cover 21. This gives a fine appearance to the laser printer 1.

Although the covering member 24 has the inclined first surface 241, the holding portion 24A of the covering member 24 is provided at the upper end portion of the covering member 24, that is, the second surface 242 extending vertically. Thus, the holding portion 24A is disposed in an easy-to-see place, which facilitates operability of the covering member 24.

Figure 5:
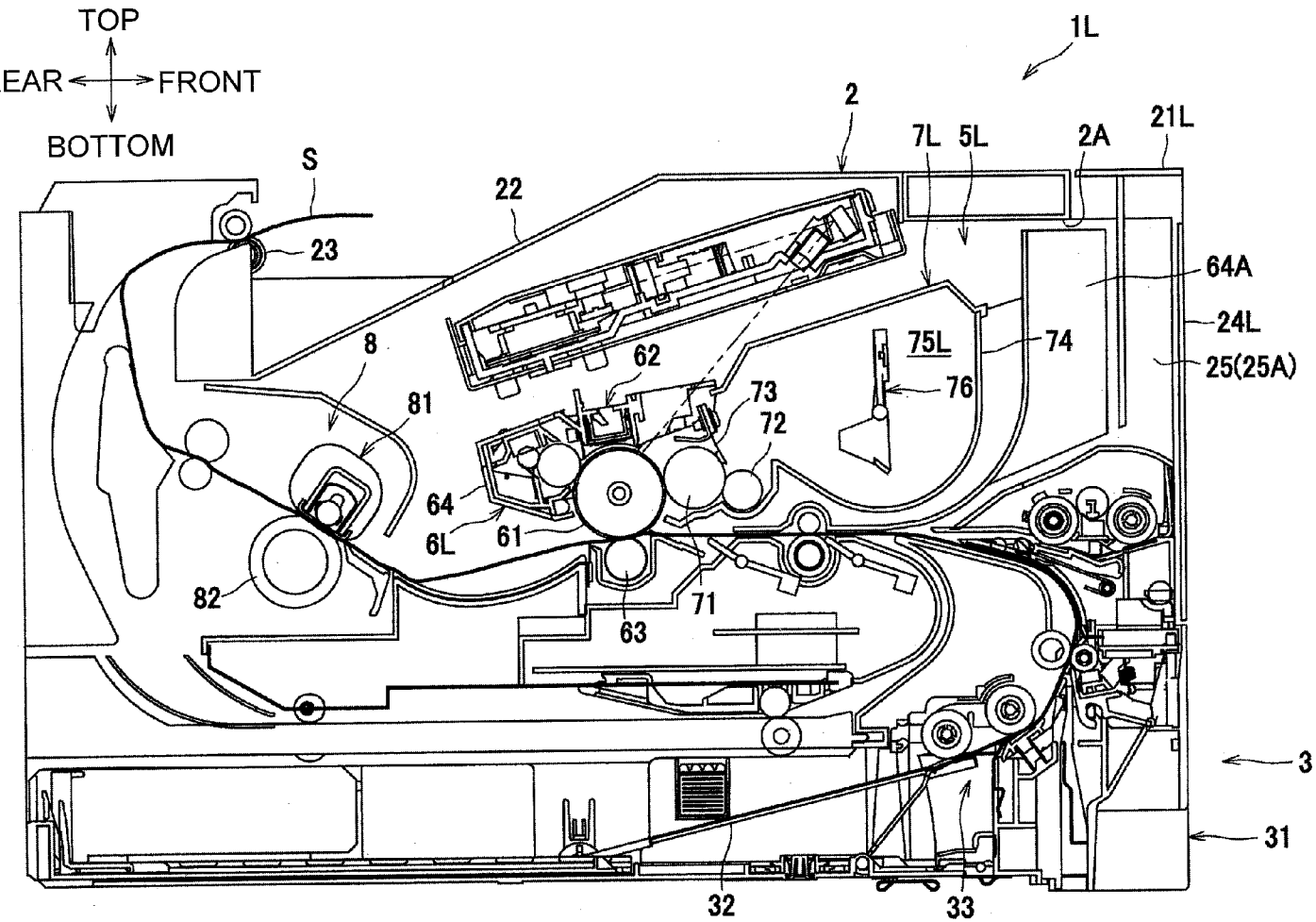
FIG. 5 is a sectional view of a laser printer to which a small-quantity process cartridge is detachably attachable.

As shown in FIG. 5, the casing 2 of the embodiment can be used for a laser printer 1L configured to accommodate a small-sized, small-capacity process cartridge 5L by attaching not the front cover 21 but a front cover 21L, which is flush with the front surface 31A of the supply sheet tray 31, that is, which does not protrude toward the front relative to the supply sheet tray 31. In other words, the casing 2 is interchangeable between the laser printer 1 configured to accommodate the large-sized process cartridge 5 and the laser printer 1L configured to accommodate only the small-sized process cartridge 5L.

The small-capacity process cartridge 5L includes a small-capacity developing cartridge 7L having a toner storing portion 75L, which is smaller in capacity than the toner storing portion 75, and a small-capacity drum cartridge 6L, which is smaller in size than the drum cartridge 6. The small-capacity process cartridge 5L accommodated in the laser printer 1L is disposed further toward the rear than the side frame 25A.

The above embodiment shows, but is not limited to, that the first part 21A of the front cover 21 protrudes toward the front relative to the front surface 31A of the supply sheet tray 31. Only a part of the front cover 21 corresponding to the opening 2A may protrude toward the front relative to the front surface 31A of the supply sheet tray 31.

The above embodiment shows, but is not limited to, that the upper end of the second surface 242 of the covering member 24 is the holding portion 24A. The holding portion may be provided at a left, right or lower end of the second surface 242 of the covering member 24.

The embodiment shows, but is not limited to, the process cartridge 5 as an example of a cartridge. The cartridge may be replaced with a developing cartridge, a drum cartridge, or a toner cartridge storing toner therein.

The embodiment shows, but is not limited to, the laser printer 1 as an example of the image forming apparatus. The disclosure may be applied to a copying apparatus or a multi-functional apparatus.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

a casing including a first side frame and a second side frame disposed opposite to the first side frame, the casing having an opening defined between the first side frame and the second side frame;

a cartridge configured to be attached to and removed from the casing through the opening, a first side and a second side of the cartridge being supported by the first side frame and the second side frame, respectively, when the cartridge is attached to the casing; and an openable member configured to open and close the opening, wherein a part of the cartridge attached to the casing protrudes in a removal direction of the cartridge relative to an end of each of the first side frame and the second side frame in the removal direction, wherein the openable member includes a wall portion, wherein, when the openable member closes the opening, the wall portion of the openable member is spaced apart in the removal direction from the part of the cartridge attached to the casing, wherein the openable member includes a first part and a second part, and wherein, when the openable member closes the opening of the casing, the first part is flush with each of a first sidewall and a second side wall of the casing, which are parallel to the first side frame and the second side frame, and the second part is flush with an upper wall of the casing.

2. The image forming apparatus according to claim 1, further comprising a supply sheet tray configured to be attached to a lower portion of the casing, wherein the openable member is disposed above the supply sheet tray, and wherein an outside surface of the openable member has an inclined surface that is inclined, relative to a vertical direction and in the removal direction, from a position above the supply sheet tray to an upper portion of the openable member.

3. The image forming apparatus according to claim 1, wherein the openable member is configured to pivot about a pivot axis, wherein the cartridge includes a photosensitive drum, and wherein the pivot axis of the openable member is parallel to a rotational axis of the photosensitive drum.

4. The image forming apparatus according to claim 3, wherein a lower end of the openable member includes the pivot axis.

5. The image forming apparatus according to claim 3, further comprising a covering member configured to pivot relative to the openable member, wherein the openable member has an opening therein, and wherein the covering member is configured to pivot to open and close the opening of the openable member when the openable member closes the opening of the casing.

6. The image forming apparatus according to claim 5, wherein the wall portion of the openable member is disposed between the covering member and the cartridge attached to the casing.

7. The image forming apparatus according to claim 5, wherein, when the covering member closes the opening of the openable member, the covering member is flush with the openable member.

8. The image forming apparatus according to claim 5, wherein the covering member is pivot about a pivot axis parallel to the pivot axis of the openable member.

9. An image forming apparatus comprising:

a casing including a first side frame and a second side frame disposed opposite to the first side frame, the casing having an opening defined between the first side frame and the second side frame;

a cartridge configured to be attached to and removed from the casing through the opening, a first side and a second side of the cartridge being supported by the first side frame and the second side frame, respectively, when the cartridge is attached to the casing;

an openable member configured to open and close the opening, and a covering member configured to pivot relative to the openable member, wherein a part of the cartridge attached to the casing protrudes in a removal direction of the cartridge relative to an end of each of the first side frame and the second side frame in the removal direction, wherein the openable member includes a wall portion, wherein, when the openable member closes the opening, the wall portion of the openable member is spaced apart in the removal direction from the part of the cartridge attached to the casing, and wherein the covering member includes a tray portion configured to receive a recording sheet.

10. The image forming apparatus according to claim 9, wherein an outside surface of the openable member has an inclined surface that is inclined relative to a vertical direction and in the removal direction, from a position above the supply sheet tray to an upper portion of the openable member, and a vertical surface extending vertically from the inclined surface, and wherein the covering member has a first surface configured to be flush with the inclined surface of the openable member when closed and a second surface configured to be flush with the vertical surface of the openable member when closed.

11. The image forming apparatus according to claim 10, wherein the covering member includes a holding portion disposed on an edge of the second surface of the covering member.

* * * * *